US008668316B2

(12) United States Patent
Takahashi et al.

(10) Patent No.: US 8,668,316 B2
(45) Date of Patent: Mar. 11, 2014

(54) LIQUID EJECTION HEAD AND RECORDING APPARATUS

(71) Applicant: Canon Kabushiki Kaisha, Tokyo (JP)

(72) Inventors: Sayaka Takahashi, Kawasaki (JP); Chiaki Muraoka, Kawaguchi (JP); Masafumi Takimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/774,034

(22) Filed: Feb. 22, 2013

(65) Prior Publication Data

US 2013/0222489 A1 Aug. 29, 2013

(30) Foreign Application Priority Data

Feb. 28, 2012 (JP) ..... 2012-041422

(51) Int. Cl.
*B41J 2/175* (2006.01)

(52) U.S. Cl.
USPC ..... 347/85

(58) Field of Classification Search
USPC ..... 347/85
See application file for complete search history.

(56) References Cited

U.S. PATENT DOCUMENTS

| | | | |
|---|---|---|---|
| 7,862,159 | B2 | 1/2011 | Tatsumi et al. |
| 7,963,635 | B2 | 6/2011 | Oikawa et al. |
| 8,052,251 | B2 | 11/2011 | Kudo et al. |
| 8,087,759 | B2 | 1/2012 | Oikawa et al. |
| 8,100,505 | B2 | 1/2012 | Kuroda et al. |
| 8,231,203 | B2 | 7/2012 | Akama et al. |

FOREIGN PATENT DOCUMENTS

| | | | |
|---|---|---|---|
| JP | 2009-90572 | A | 4/2009 |

*Primary Examiner* — Matthew Luu
*Assistant Examiner* — Alexander D Shenderov
(74) *Attorney, Agent, or Firm* — Fitzpatrick, Cella, Harper & Scinto

(57) ABSTRACT

A liquid ejection head is constructed by providing a recording element substrate on a supporting member. The recording element substrate has at least one thermal energy generating element and a liquid supply port for supplying liquid to the element. The supporting member has three or more supply flow paths running therethrough. Two or more beams are formed in each of the supply flow paths. The gap between the beams formed in each of the end supply flow paths is greater than the gap between the beams formed in an inside supply from path.

10 Claims, 8 Drawing Sheets

LIQUID EJECTION HEAD AND RECORDING APPARATUS

BACKGROUND OF THE INVENTION

1. Field of the Invention

The present invention relates to a liquid ejection head that ejects liquid such as ink and also to a recording apparatus that operates for recording on a recording medium by means of such a liquid ejection head.

2. Description of the Related Art

More and more inkjet type recording apparatus have been employed in recent years and are currently being employed for so-called large format printing to exploit the advantages of inkjet recording by ejecting liquid such as ink. Large format printing refers to printing (recording) on recording mediums having a relatively large printing area such as large posters to be used for advertisements of events and various presentations. Some recording apparatus capable of recording on an about 2 m wide recording medium have been put to practical use.

Recording mediums for large format printing have a relatively large recording area. Therefore, recording apparatus for large format printing are required to operate at high speed for printing. For this reason, liquid ejection heads utilizing electrothermal transducer elements that can accommodate high speed printing are adopted in recording apparatus for large format printing.

Now, the configuration and the operation of a liquid ejection head utilizing electrothermal transducer elements will be described below.

The liquid ejection head includes a recording element substrate having electrothermal transducer elements and a supporting member for supporting the recording element substrate. The recording element substrate is formed with a supply port for supplying ink to the inside and the supporting member is formed with a supply flow path communicating with the supply port. Additionally, the recording element substrate is formed with a plurality of ejection ports for ejecting the ink supplied through the supply flow path.

The liquid ejection head is so designed as to apply electric energy to the electrothermal transducer elements according to the recording signals received from the recording apparatus main body and rapidly raise the temperature of electrothermal transducer elements. The thermal energy of the electrothermal transducer elements is transmitted to the ink inside the recording element substrate to make the ink represent a phase change. The air bubble pressure generated as a result of the phase change of the ink is converted into ejection energy so that the ink in the recording element substrate is ejected from the ejection ports.

In a liquid ejection head utilizing electrothermal transducer elements, the electric energy applied to the electrothermal transducer elements is partly accumulated in the recording element substrate as thermal energy. The thermal energy accumulated in the recording element substrate is then transmitted to the outside of the liquid ejection head by way of the supporting member. When the liquid ejection head is driven to eject ink continuously, the quantity of the thermal energy applied from the electrothermal transducer elements to the recording element substrate is greater than the quantity of the thermal energy transmitted from the recording element substrate to the supporting member to consequently raise the temperature of the recording element substrate.

Particularly, the part of the recording element substrate that faces the opening of the supply flow path is not held in contact with the supporting member. Therefore, the thermal energy of that part of the recording element substrate is hardly transmitted to the supporting member if compared with the part of the recording element substrate that is held in contact with the supporting member. In other words, the temperature of the former part of the recording element substrate tends to be raised easily.

When the temperature of the recording element substrate rises above a certain level, the ink ejecting operation becomes unstable to by turn deteriorate the quality of the image recorded by the liquid ejection head. Additionally, the temperature of the parts of the recording element substrate located close to the ejection ports and the quantity of the ejected ink are correlated and, if the temperature in the inside of the recording element substrate varies to a large extent, the ink ejection rates of the ejection ports will also vary among them to a large extent. Then, as a result, uneven image density is caused in the recorded image to consequently deteriorate the quality of the recorded image.

As an attempt to prevent such image quality deterioration, recording apparatus including a liquid ejection head that utilizes electrothermal transducer elements are mostly so controlled as to temporarily suspend the recording operation before the temperature of the recording element substrate rises above a certain level or becomes to be dispersed to a large extent. Temperature rises and temperature variance in the recording element substrate are suppressed by suspending the recording operation of the recording apparatus to secure the time required to emit thermal energy from the recording element substrate and also the time required to flatten the temperature distribution in the recording element substrate.

However, with large format printing, the image recorded on a recording medium more often than not spreads continuously in the recording area. When the recording operation is suspended while recording a continuous image, the tint of the ink ejected on the recording medium can vary in the continuous image to deteriorate the quality of the recorded image. For this reason, liquid ejection heads for large format printing are required to have a structure that does not give rise to temperature rises and temperature variance in the recording element substrate if a recording operation is conducted continuously for a relatively long period of time.

Japanese Patent Application Laid-Open Publication No. 2009-90572 discloses an exemplar liquid ejection head that can effectively suppress temperature rises and temperature variance in its recording element substrate. The liquid ejection head disclosed in Japanese Patent Application Laid-Open Publication No. 2009-90572 includes a plurality of beams held in contact with the recording element substrate. Since the heat in the part of the recording element substrate that faces the opening of the supply flow path is mostly released to the outside by way of the beams, the temperature rise of that part is suppressed. Additionally, since thermal energy is transmitted from the inside of the recording element substrate to the beams at a plurality of spots, the temperature variance in the recording element substrate is suppressed.

However, Japanese Patent Application Laid-Open Publication No. 2009-90572 discloses only a liquid ejection head having a single supply flow path in its supporting member. The inventors of the present invention have found that a novel problem arises when a plurality of supply flow paths are formed in a liquid ejection head disclosed in Japanese Patent Application Laid-Open Publication No. 2009-90572.

This novel problem will be described below by referring to FIGS. 10A through 10D.

FIG. 10A is a schematic plan view of a liquid ejection head of the type under consideration that has three supply flow paths in the supporting member. FIG. 10B is a schematic cross-sectional view of the liquid ejection head taken along line 10B-10B in FIG. 10A. FIG. 10C is a schematic plan view of the supporting member 3 of the liquid ejection head from which its recording element substrate has been removed.

As seen from FIGS. 10A through 10C, the liquid ejection head includes three recording element substrates 2*a*, 2*b* and 2*c* having respective ejection ports 1 and a supporting member 3 for supporting the recording element substrates 2*a*, 2*b* and 2*c*. The supporting member 3 has three supply flow paths 4 and the openings of the three supply flow paths 4 are aligned in the first direction X running along the surface of the supporting member 3.

The recording element substrates 2*a*, 2*b* and 2*c* are rigidly secured at positions where they cover the respective openings of the supply flow paths 4. Each of the recording element substrate 2*a*, 2*b* and 2*c* is formed with two supply ports 5 such that a single supply flow path 4 communicates with two supply ports 5.

The liquid ejection head has a pair of beams 6 extending along the first direction X in each of the supply flow paths 4. The pairs of beams 6 are held respectively in contact with the recording element substrates 2*a*, 2*b* and 2*c* through the openings of the supply flow paths 4. The paired beams 6 arranged in each of the supply flow paths 4 are separated from each other by gap D in the second direction Y intersecting the first direction X.

The inventors of the present invention computationally determined the temperature distributions in each of the recording element substrates 2*a*, 2*b* and 2*c* along the second direction Y. FIG. 10D is a graph illustrating the computationally determined temperature distributions.

In the graph illustrated in FIG. 10D, the horizontal axis represents temperatures and the vertical axis represents positions in the second direction Y on each of the recording element substrates 2 (positions on the temperature measurement lines M illustrated in FIG. 10A). The wide solid line in the graph indicates the temperature distribution in the recording element substrate 2*b* located between the other two recording element substrates as viewed in the first direction and the narrow solid line and the dotted line in the graph respectively indicate the temperature distributions in the recording element substrates 2*a* and 2*c* located at the opposite ends as viewed in the first direction X.

As seen from FIG. 10D, the temperatures in the recording element substrate 2*b* located between the other two recording element substrates are higher than the corresponding temperatures in the other recording element substrates 2*a* and 2*c* located at the opposite ends. This is because thermal energy is mainly transmitted from the recording element substrates 2*a* and 2*c* to the partition walls 7 separating the supply flow paths 4 and also to the walls located outside the supply flow paths 4 as viewed in the first direction X but from the recording element substrate 2*b* only to the partition walls 7 separating the supply flow paths 4.

The openings of the three supply flow paths 4 are respectively covered by separate recording element substrates 2*a*, 2*b* and 2*c* in the liquid ejection head illustrated in FIGS. 10A through 10C. If the three supply flow paths 4 are covered by a single recording element substrate, the temperatures in the center section thereof are supposed to be higher than the corresponding temperatures in the opposite end sections so that temperature distributions graph similar to the one represented in FIG. 10D may be obtained.

As illustrated in FIG. 10D, since temperature differences exist between the recording element substrate 2*b* and the other recording element substrates 2*a* and 2*c*, the ink ejection rate varies between the recording element substrate 2*b* and the other recording element substrates 2*a* and 2*c*, and therefore, uneven image density is caused in the recorded image to consequently deteriorate the quality of the recorded image.

Particularly, of recording apparatus of the type under consideration, the ejection ports 1 (FIG. 10B) arranged in an intermediate portion of each of the recording element substrates 2 as viewed in the second direction Y (in the positional range between about −3 mm and about −22 mm in the graph of FIG. 10D) are mostly used to eject ink. Therefore, if the temperatures in such an intermediate portion represent variance among the recording element substrates, uneven image density can easily be caused in the recorded image.

SUMMARY OF THE INVENTION

According to the present invention, the above identified problems can be dissolved by providing a liquid ejection head including: a recording element substrate having a supply port for supplying liquid to the inside and adapted to apply heat to the liquid supplied from the supply port and eject the liquid; a supporting member having a supporting surface for supporting the recording element substrate and supply flow paths communicating with the supply port and running through the supporting member from the supporting surface to the surface opposite to the supporting surface, the recording element substrate being so disposed as to stride over the openings of the supply flow paths; and at least two beams arranged in each inside of the supply flow paths and held in contact with the recording element substrate. The supporting member has at least three supply flow paths. The openings of the at least three supply flow paths are aligned in the first direction running along the supporting surface. The at least two beams arranged in each of the three supply flow paths are separated from each other by a gap as viewed in the second direction intersecting the first direction and running along the supporting surface. The gap separating in the second direction the at least two beams arranged in each inside of the supply flow paths disposed at the ends as viewed in the first direction out of the at least three supply flow paths is greater than the gap separating in the second direction the at least two beams arranged in the supply flow path disposed intermediately relative to the other supply flow paths as viewed in the first direction.

In another aspect of the present invention, there is provided a liquid ejection head including: a recording element substrate having elements for generating thermal energy to be utilized to eject liquid and a supply port for supplying liquid to the elements; and a supporting member having a supporting surface for supporting the recording element substrate and supply flow paths communicating with the supply port and running through the supporting member from the supporting surface to the surface opposite to the supporting surface. The supply flow paths include the first, the second and the third supply flow paths arranged in parallel in the above mentioned order as viewed in the first direction, and two beams are formed in each of the supply flow paths so as to extend in the first direction and to be separated from each other by a gap as viewed in the second direction orthogonal relative to the first direction. That gap separating the two beams of each of the first and third supply flow paths, the beams being formed at the center side as viewed in the second direction, is greater than the gap separating the two beams of the second supply flow path, the beams being formed at the center side as viewed in the second direction.

Further features of the present invention will become apparent from the following description of exemplary embodiments with reference to the attached drawings.

DESCRIPTION OF THE EMBODIMENTS

The embodiments of the present invention will be described below with reference to the accompanying drawings.

First Embodiment

Now, the liquid ejection head of the first embodiment of the present invention for ejecting liquid such as ink will be described below by referring to FIGS. 1 through 5A and 5B.

Figure 1:
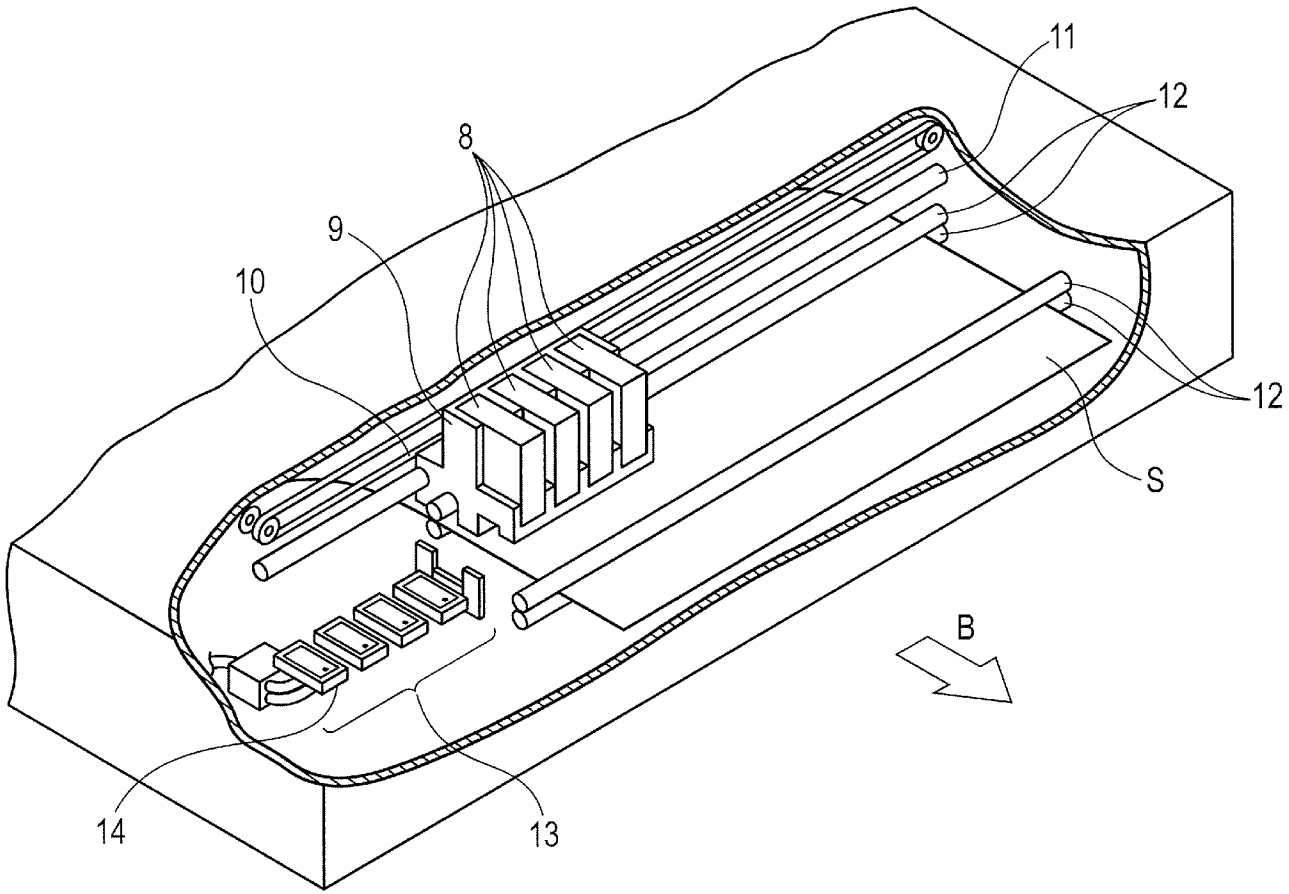
FIG. 1 is a schematic perspective view illustrating a configuration of a recording apparatus including a liquid ejection head according to a first embodiment of the present invention.

FIG. 1 is a schematic perspective view of a configuration of a recording apparatus including a liquid ejection head according to the present embodiment. As illustrated in FIG. 1, the recording apparatus includes an ink tank 8, a liquid ejection head 9 adapted to eject the ink supplied from the ink tank 8 through an ejection port thereof according to recording information, and a carriage that can be removably mounted on the liquid ejection head 9.

A so-called cartridge system is adopted in the liquid ejection head 9 and can eject ink of different colors that may include black, cyan, magenta and yellow. Then, ink tanks 8 for the colors of black, cyan, magenta and yellow are independently and removably mounted in the cartridge 10 for the liquid ejection head 9 so as to correspond to the different colors of ink to be ejected from the liquid ejection head 9.

The cartridge 10 is slidably supported by a guide rail 11 and driven to move alternately backward and forward along the guide rail 11 by a drive unit such as an electric motor (not illustrated). The liquid ejection head 9 moves as the cartridge 10 is driven to move.

A recording medium S is arranged to face the ink ejection surface of the liquid ejection head 9 and conveyed by a conveyor roller 12 in the direction that intersects the moving direction of the cartridge 10 (as indicated by white arrow B in FIG. 1), while constantly maintaining a same distance relative to the ink ejection surface. The recording medium S may be a sheet of ordinary recording paper, special paper or OHP film.

The recording apparatus repeats the operation of driving the liquid ejection head 9 to move alternately backward and forward (main scanning) and that of conveying the recording medium S that may be a sheet of ordinary recording paper, special paper or OHP film with a predetermined pitch (sub scanning). One or more characters, signs and/or images are produced as ink droplets are selectively ejected from the liquid ejection head 9 in synchronism with these operations and forced to adhere to the recording medium S.

The recording apparatus also includes a recovery unit 13 that operates for suction recovery of the liquid ejection head 9. The recovery unit 13 is arranged so as to face the ink ejection surface of the liquid ejection head 9 within the range of reciprocating motion thereof and also within the recording region that is a region outside the passing range of the recording medium S. The suction recovery operation is executed by cap units 14 that respectively correspond to the rows of ejection ports of four different colors of black, cyan, magenta and yellow.

Now, the configuration of the liquid ejection head 9 will be described below by referring to FIG. 2 through FIGS. 5A and 5B.

Figure 2:
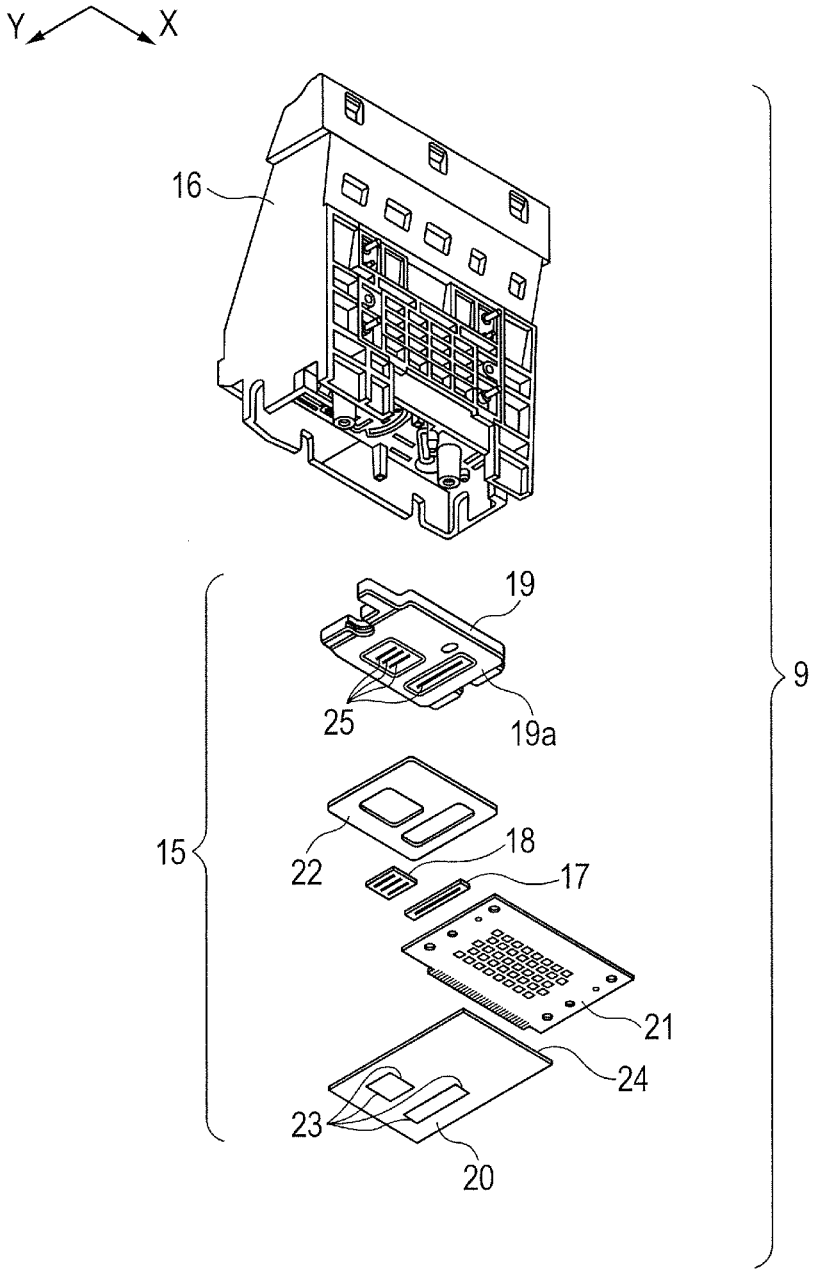
FIG. 2 is an exploded schematic perspective view of the liquid ejection head according to the first embodiment.

FIG. 2 is an exploded schematic perspective view of the liquid ejection head 9. As illustrated in FIG. 2, the liquid ejection head 9 includes a recording element unit 15 and an ink supply member 16.

The recording element unit 15 has a first recording element substrate 17 for ejecting black ink, a second recording element substrate 18 for ejecting cyan ink, magenta ink and yellow ink, and a first plate 19. The first and second recording element substrates 17 and 18 are supported on one of the surfaces of the first plate 19. In other words, the first plate 19 operates as a supporting member for supporting the first and second recording element substrates 17 and 18. The first plate 19 that operates as a supporting member is made of aluminum oxide ($Al_2O_3$). The above cited surface of the first plate 19 will be referred to as supporting surface 19*a* hereinafter.

The recording element unit 15 additionally has an electric wiring tape 20, an electric contact substrate 21 for receiving electric signals from the recording apparatus and a second plate 22.

The electric wiring tape 20 is electrically connected to the first recording element substrate 17 and also to the second recording element substrate 18. The electric wiring tape 20 has a plurality of apertures for inserting the first and second recording element substrates 17 and 18, and an electrode terminal 23 that corresponds to the electrode sections of the first and second recording element substrates 17 and 18. An electrode terminal section 24 that is to be electrically connected to the electric contact substrate 21 is arranged at an end of the electric wiring tape 20.

Figure 3:
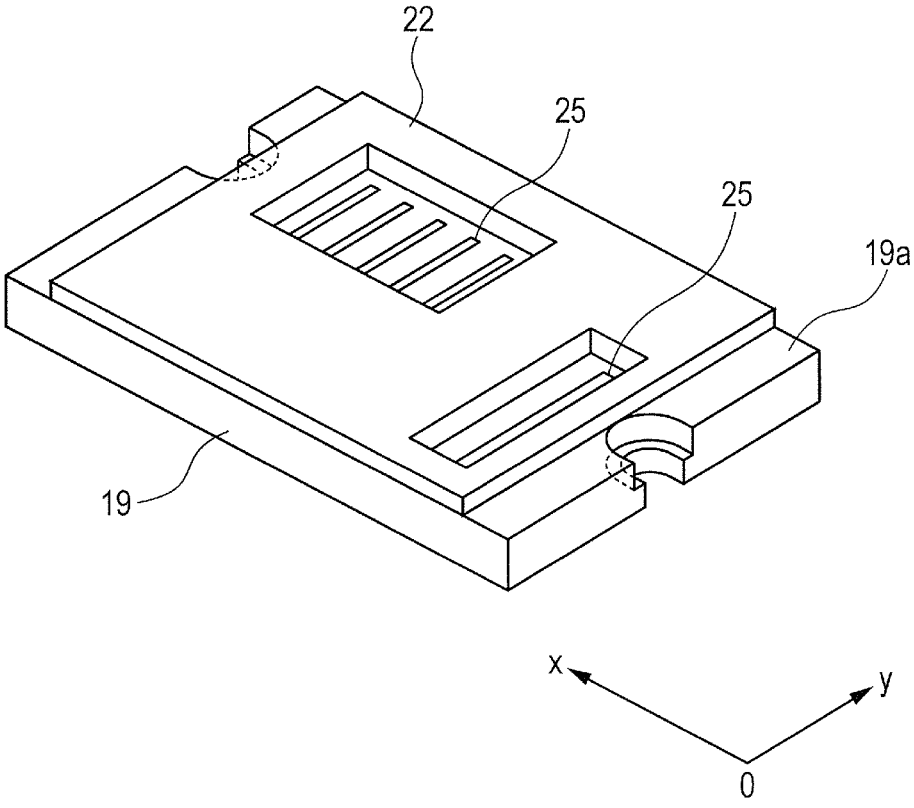
FIG. 3 is a schematic perspective view of the first and second plates of the liquid ejection head.

FIG. 3 is a schematic perspective view of the first and second plates 19 and 22. As illustrated in FIG. 3, the second plate 22 is formed with windows and the first and the second recording element substrates 17 and 18 are inserted into the respective windows. The first plate 19 is formed with openings of supply flow paths 25 for supplying ink to the first and second recording element substrates 17 and 18 in regions that correspond to the respective windows.

The supply flow paths 25 run all the way between the supporting surface 19*a* and the surface opposite to the supporting surface 19*a* of the first plate 19. The first and second recording element substrates 17 and 18 (FIG. 2) are so arranged at the supporting surface 19*a* as to stride over the openings of the supply flow paths 25.

Figure 4A:
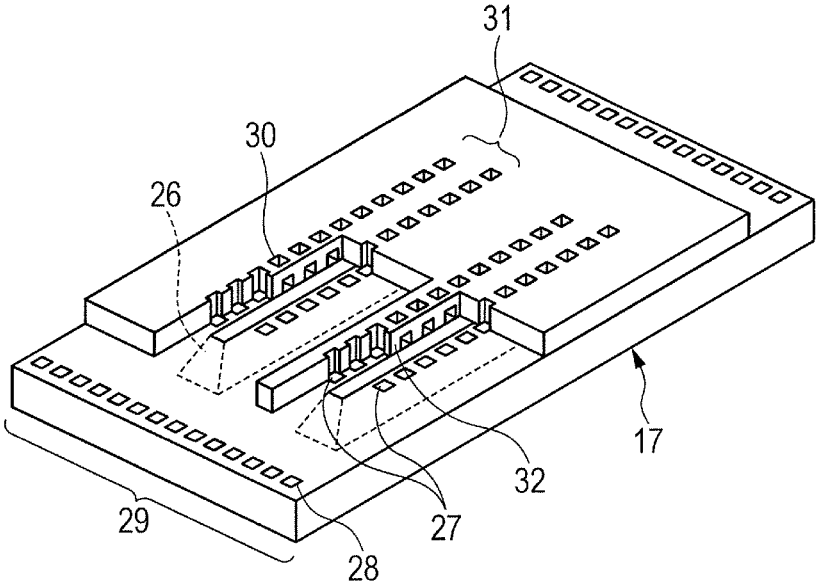
FIGS. 4A and 4B are respectively partly cut-away perspective views of the first and second recording element substrates.
Figure 4B:
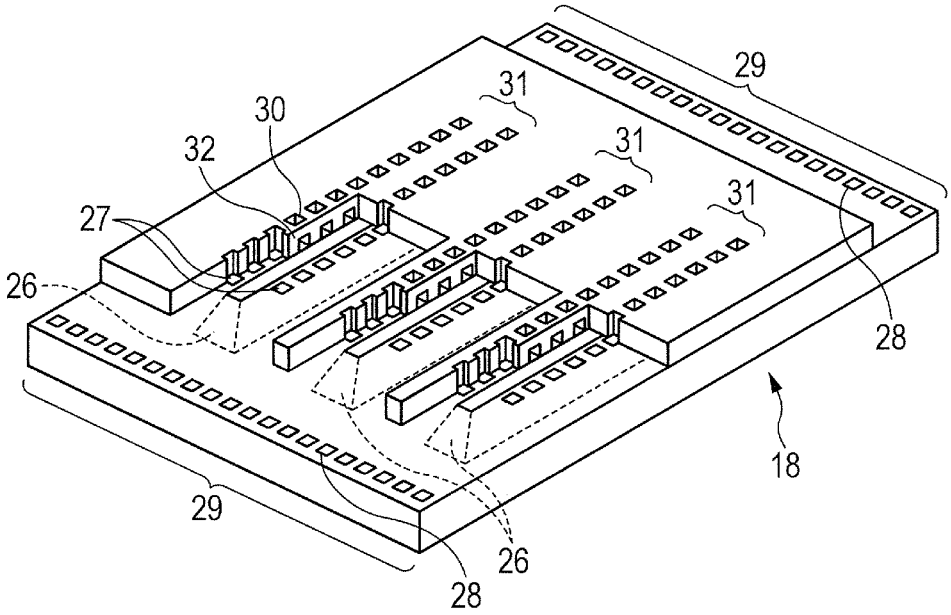

FIGS. 4A and 4B are partly cut-away perspective views of the first and second recording element substrates 17 and 18, respectively. As illustrated in FIGS. 4A and 4B, the first and second recording element substrates 17 and 18 are formed with supply ports 26 for supplying ink to the inside as so many oblong holes. Electrothermal transducer elements 27 that operate as so many heat emitting elements are arranged in two rows at the respective opposite sides of each of the supply ports 26. The electrothermal transducer elements 27 of the two rows are arranged in a zigzag manner so as not to squarely face each other.

The electrothermal transducer elements 27 are electrically connected to an electrode section 29 that has bumps 28 such as Au by way of electric wiring (not illustrated). Electricity is supplied from the outside of the first and second recording element substrates 17 and 18 to the electrothermal transducer elements 27 by way of the electrode section 29.

The first and second recording element substrates 17 and 18 additionally have rows of ejection ports 31 formed by a plurality of ejection ports 30 and ink flow path walls 32 for forming ink flow paths that correspond to the electrothermal transducer elements 27. Since the ejection ports 30 are arranged oppositely relative to the electrothermal transducers 27, the ink supplied from each of the supply ports 26 is ejected from the related ejection port 30 by the bubbles generated by the related electrothermal transducer elements 27. The ejection ports 30 and the ink flow path walls 32 can typically be formed by using a resin material and a photolithography technique.

Figure 5A:
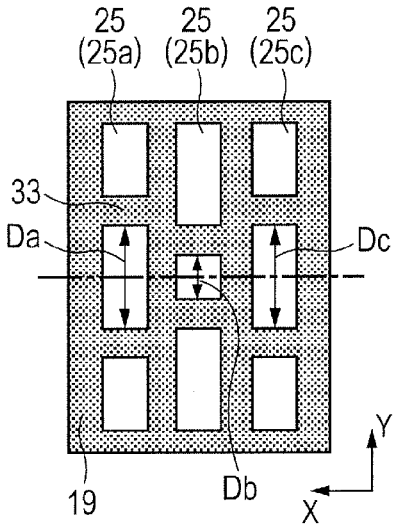
FIG. 5A is an enlarged schematic plan view of a part of the first plate of the liquid ejection head of the first embodiment.

FIG. 5A is an enlarged schematic plan view of the part of the first plate 19 that supports the second recording element substrate 18. As illustrated in FIG. 5A, three supply flow paths 25*a*, 25*b* and 25*c* are formed in that part of the first plate 19. The three supply flow paths 25*a*, 25*b* and 25*c* communicate respectively with the three supply ports 26 (see FIG. 4B) of the second recording element substrate 18 so that cyan ink, magenta ink and yellow ink can separately be supplied to the second recording element substrate 18.

Two beams 33 are arranged in each of the supply flow paths 25*a*, 25*b* and 25*c* and held in contact with the second recording element substrate 18 in the openings of the supply flow paths. As the back surface of the recording element substrate 18 is held in contact with and bonded to the beams, heat is released from the parts of the second recording element substrate 18 that correspond to the openings of the supply flow paths 25 to the outside by way of the beams 33 so that any temperature rise of those parts are effectively suppressed.

The three supply flow paths 25*a*, 25*b* and 25*c* are arranged sequentially in the first direction X that runs along the surface of the first plate 19 such that the supply flow path 25*b* is located between the other two supply flow paths 25*a* and 25*c* that are located at the opposite ends as viewed in the first direction X.

The two beams 33 in each of the supply flow paths 25*a*, 25*b* and 25*c* are separated from each other by a gap as viewed in second direction Y that intersects the first direction X and the beams substantially have a same length in second direction Y. However, both the gap Da separating the two beams 33 arranged in the supply flow paths 25*a* and the gap Dc separating the two beams 33 arranged in the supply flow path 25*c* are greater than the gap Db separating the two beams 33 arranged in the supply flow path 25*b*.

Figure 5B:
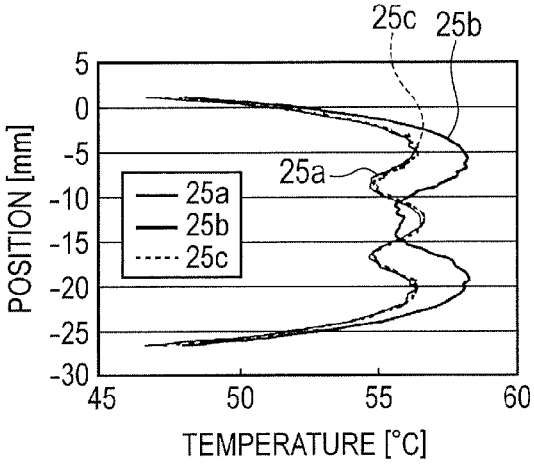
FIG. 5B is a graph illustrating the temperature distributions of the second recording element substrate.

FIG. 5B is a graph illustrating the temperature distributions of the second recording element substrate 18 that is supported by the first plate 19. Note that the temperature distributions are the results of a simulation that was carried out by computations for the portions of the second recording element substrate 18 (see FIG. 4B) that respectively correspond to the supply flow paths 25*a*, 25*b* and 25*c* in terms of the second direction Y.

In the graph illustrated in FIG. 5B, the horizontal axis represents temperatures and the vertical axis represents positions on the second recording element substrate 18 in the second direction Y. The narrow solid line, the wide solid line and the dotted line in the graph respectively indicate the temperature distributions of the portions of the second recording element substrate 18 that correspond to the supply flow paths 25*a*, 25*b* and 25*c*.

Figure 10A:
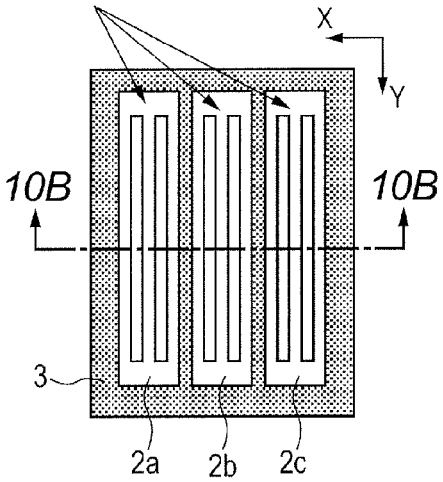
FIG. 10A is a schematic plan view of a known liquid ejection head represented for the purpose of comparison.
Figure 10B:
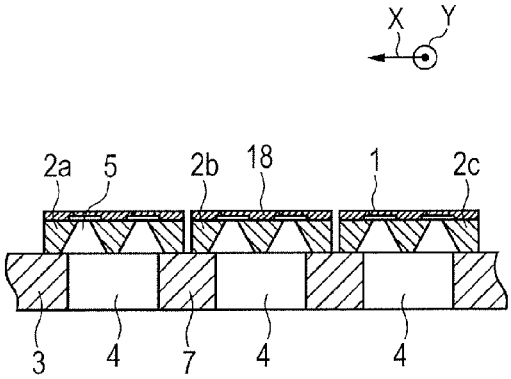
FIG. 10B is a schematic cross-sectional view of the liquid ejection head of FIG. 10A.
Figure 10C:
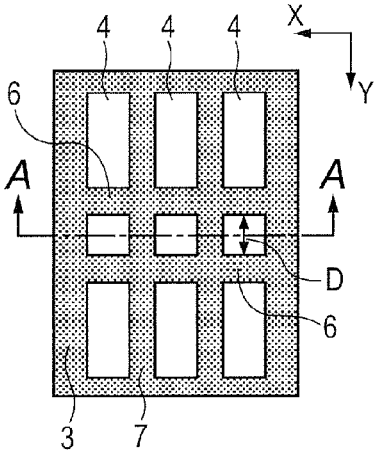
FIG. 10C is a schematic plan view of the supporting member thereof.
Figure 10D:
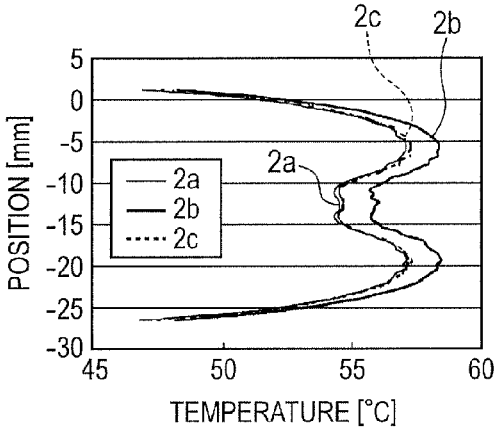
FIG. 10D is a graph illustrating the temperature distributions of the recording element substrate thereof.

As will be realized by comparing the graph illustrated in FIG. 5B and the one represented in FIG. 10D, the temperature represents less variance in an intermediate portion of the second recording element substrate 18 as viewed in the second direction Y if compared with the temperature of the comparable known recording element substrate.

More specifically, as for the positional range between about −3 mm and about −22 mm in the second direction Y of the second recording element substrate 18 that corresponds to the supply flow paths 25*a* and 25*c*, the following statement holds true.

Namely, the lowest temperature of the known liquid ejection head is about 54° C. (see the narrow solid line and the dotted line in FIG. 10D), whereas the lowest temperature of the liquid ejection head of this embodiment is about 55° C. (see the narrow solid line and the dotted line in FIG. 5B). Additionally, the highest temperature of the known liquid ejection head is about 57° C. (see the narrow solid line and the dotted line in FIG. 10D), whereas the highest temperature of the liquid ejection head of this embodiment is about 56.5° C. (see the narrow solid line and the dotted line in FIG. 5B). Therefore, the temperature difference of the portions in the second recording element substrate 18 that correspond to the supply flow paths 25*a* and 25*c* is reduced in the liquid ejection head of this embodiment.

This reduction in the temperature difference is realized for the following two reasons. One of the reasons is that thermal energy can be transmitted less easily from portions that respectively correspond to the supply flow paths 25*a* and 25*c* and are located at and near the center in the second direction Y to the beams 33 in the supply flow path 25*a* and 25*c*. The other reason is that thermal energy can be transmitted more easily from the portions that correspond respectively to the supply flow paths 25*a* and 25*c* and are at the highest temperature level in the second direction Y to the beams 33 in the supply flow paths 25*a* and 25*c* and heat can be easily released from those portions.

As described above, with the liquid ejection head of this embodiment, where three supply flow paths are formed in the supporting member thereof, transmission of thermal energy from the recording element substrates that correspond to the supply flow paths located at the opposite ends is suppressed so that consequently a less dispersed temperature distribution can be achieved for those recording element substrates. Then, as a result, the variance among the ejection rates of the ejection ports can be suppressed to prevent the quality of recorded images from being deteriorated.

Particularly, when this liquid ejection head according to the present embodiment is applied to a recording apparatus for large format printing, the recording apparatus can be operated continuously longer than before because temperature variance less likely occurs inside the recording element substrate. Then, the tint of the ink ejected on the recording medium would not vary in the continuous image to improve the quality of the recorded image.

While three supply flow paths 25*a*, 25*b* and 25*c* are formed in the first plate 19 in order to supply cyan ink, magenta ink and yellow ink in this embodiment, ink colors that may be used for printing are not necessarily limited to those three colors. This embodiment is applicable to a liquid ejection head having four or more supply flow paths.

While two beams 33 are arranged in each of the three supply flow paths 25*a*, 25*b* and 25*c* in the above description, more than two beams may alternatively be arranged in each of the three supply flow paths 25*a*, 25*b* and 25*c*. When more than two beams are provided, the gaps Da and Dc may be used as the smallest gaps for two neighboring beams in the second direction Y in the respective supply flow paths 25*a* and 25*c*, whereas the gap Db may be used as the largest gap for two neighboring beams in the second direction Y in the supply flow path 25*b*.

While the single second recording element substrate 18 is made to communicate with the three supply flow paths 25*a*, 25*b* and 25*c* in this embodiment, a plurality of second recording element substrates, each of which communicates with the three supply flow paths 25*a*, 25*b* and 25*c*, may alternatively be provided. The design concept of this embodiment is also applicable to the part of the first plate 19 that supports the first recording element substrate 17.

Second Embodiment

Now, the liquid ejection head of the second embodiment of the present invention will be described below by referring to FIGS. 6A and 6B. Recording apparatus to which this embodiment is applicable are same as the one illustrated in FIG. 1 and hence will not be described here any further. Additionally, the components of the liquid ejection head of this embodiment that are same as those of the liquid ejection head of the first embodiment are denoted by the same reference symbols and will not be described in detail any further.

Figure 6A:
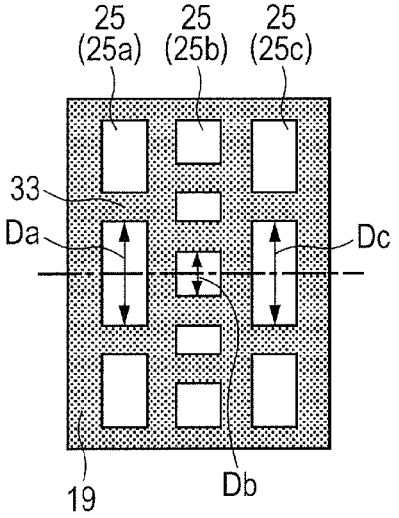
FIG. 6A is an enlarged schematic plan view of a part of the first plate of the liquid ejection head of the second embodiment of the present invention.

FIG. 6A is an enlarged schematic plan view of the part of the first plate 19 that supports the second recording element substrate 18 (see FIG. 2). As illustrated in FIG. 6A, three supply flow paths 25*a*, 25*b* and 25*c* are formed at three appropriate parts of the first plate 19. The three supply flow paths 25*a*, 25*b* and 25*c* communicate with the respective supply ports 26 (see FIG. 4B) of the second recording element substrate 18 so that ink of a plurality of colors can be supplied to the second recording element substrate 18.

Two beams 33 are arranged in each of the supply flow paths 25*a* and 25*c*. The two beams 33 of the supply flow path 25*a* and those of the supply flow path 25*c* are held in contact with the second recording element substrate 18 respectively by way of the openings of the supply flow paths 25*a* and 25*c*. On the other hand, four beams 33 are arranged in the supply flow path 25*b*. The four beams 33 of the supply flow path 25*b* are held in contact with the second recording element substrate 18 by way of the opening of the supply flow path 25*b*. Both the gap Da separating the two beams 33 arranged in the supply flow path 25*a* and the gap Dc separating the two beams 33 arranged in the supply flow path 25*c* are larger than the largest gap Db of the gaps separating the four beams 33 arranged in the supply flow path 25*b*.

Figure 6B:
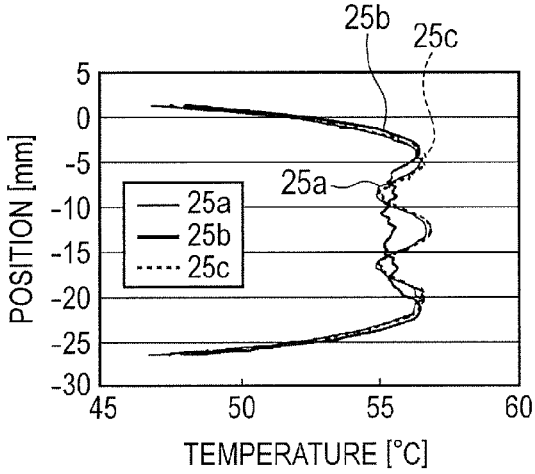
FIG. 6B is a graph illustrating the temperature distributions of the second recording element substrate.

FIG. 6B is a graph illustrating the temperature distributions of the second recording element substrate 18 that is supported by the first plate 19 illustrated in FIG. 6A. In the graph illustrated in FIG. 6B, the horizontal axis represents temperatures and the vertical axis represents positions on the second recording element substrate 18 in the second direction Y. The narrow solid line, the wide solid line and the dotted line in the graph respectively indicate the temperature distributions of the portions of the second recording element substrate 18 that correspond to the supply flow paths 25*a*, 25*b* and 25*c*.

As will be realized by seeing the graph illustrated in FIG. 6B, the highest temperature of the second recording element substrate 18 of the liquid ejection head of this embodiment is lower than that of the second recording element substrate 18 of the liquid ejection head of the first embodiment (see FIG. 5B).

More specifically, while the highest temperature of the liquid ejection head of the first embodiment is about 58° C. (see the wide solid line in FIG. 5B), the highest temperature of the liquid ejection head of this embodiment is about 57° C. (see the wide solid line in FIG. 6B). As for the positional range between about −3 mm and about −22 mm in the second direction Y of the second recording element substrate 18, the lowest temperature is about 55° C. both in the first embodiment and in the second embodiment (see the narrow solid line and the dotted line in FIG. 5B and those in FIG. 6B). Thus, the temperature difference in the second recording element substrate 18 is reduced in the liquid ejection head of this embodiment if compared with the first embodiment.

The reduction of temperature difference is caused by the provision of four beams 33 in the supply flow path 25*b* that allows thermal energy to be easily transmitted from the portion of the second recording element substrate that corresponds to the supply flow path 25*b* to the beams 33. Thus, the number of beams arranged in the supply flow path 25*b* that is located at the center side is preferably made greater than the number of beams arranged in each of the supply flow paths 25*a* and 25*c* that are located at the opposite ends.

As described above, with the liquid ejection head of this embodiment, where three supply flow paths are formed in the supporting member thereof, transmission of thermal energy from the recording element substrates that correspond to the supply flow paths located at the opposite ends is suppressed so that consequently a less dispersed temperature distribution can be achieved for those recording element substrates. Then, as a result, the variance among the ink ejection rates of the ejection ports can be suppressed to prevent the quality of recorded images from being deteriorated.

Additionally, since the highest temperatures in the recording element substrates are lowered, the ink ejecting conditions of the liquid ejection head are prevented from becoming unstable so that the quality of the recorded images will consequently be improved.

Particularly, when this embodiment of liquid ejection head is applied to a recording apparatus for large format printing, thermal energy is easily released from the recording element substrates and temperature variance hardly appears in the recording element substrates. Therefore, a recording operation can be conducted continuously for a relatively long period of time with the recording apparatus. Thus, the tint of the ink would not vary in the continuous image to improve the quality of the recorded image.

Figure 7A:
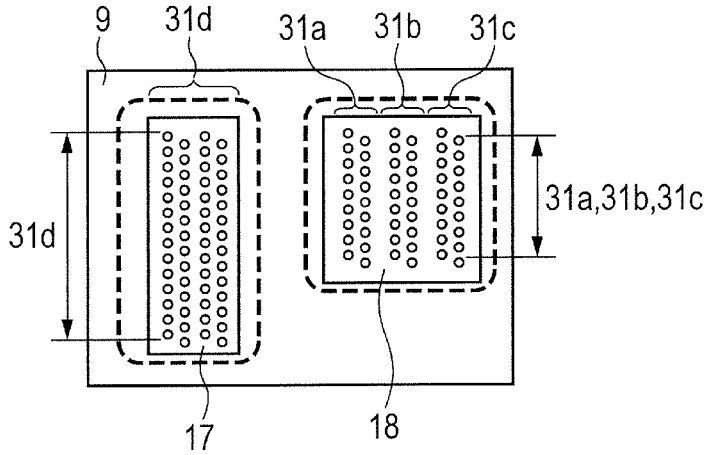
FIG. 7A is a schematic plan view of the liquid ejection head of the second embodiment, illustrating the positional arrangement of the recording element substrates and the ejection ports thereof.
Figure 7B:
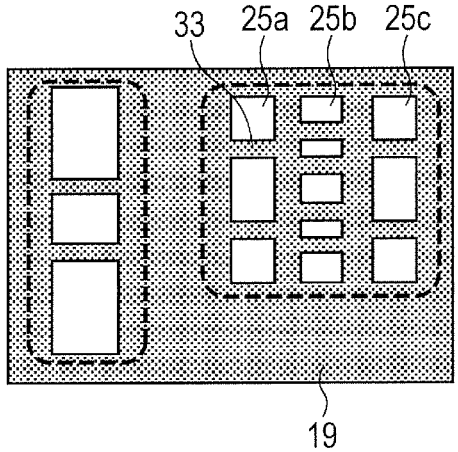
FIG. 7B is a schematic plan view of the first plate of the liquid ejection head from which the recording element substrates are taken away.

An exemplar positional arrangement of the ejection ports of the liquid ejection head of this embodiment will be described below by referring to FIGS. 7A and 7B. FIG. 7A is a schematic plan view of the liquid ejection head of this embodiment, illustrating the positional arrangement of the recording element substrates and the ejection ports thereof. FIG. 7B is a schematic plan view of the liquid ejection head illustrated in FIG. 7A from which the recording element substrates are taken away.

As illustrated in FIG. 7A, the rows of ejection ports 31*d* for ejecting black ink include more ejection ports than the rows of ejection ports 31*a*, 31*b* and 31*c* for ejecting yellow ink, magenta ink and cyan ink for the purpose of recording monochromatic black images at a relatively high speed. In this embodiment, each of the rows of ejection ports 31*d* is about 1.5 times longer than each of the rows of ejection ports 31*a*, 31*b* and 31*c*, and number of the rows of ejection ports 31*d* is about twice that of the rows of ejection ports 31*a*, 31*b* and 31*c*.

By seeing the different lengths of the rows of ejection ports and the different numbers of rows of ejection ports arranged for ink of different colors, it can be understood that the number of ejection ports arranged in the rows of ejection ports 31*d* is three times greater than the number of ejection ports arranged in the rows of ejection ports 31*a*, 31*b* and 31*c*. In other words, the rate at which the liquid ejection head can record a monochromatic black image is three times greater than the rate at which it can record a similar yellow, magenta or cyan image if the frequency at which ink is ejected from the related ejection ports is same.

Three supply flow paths 25*a*, 25*b* and 25*c* are formed side by side in the first direction X in the portion of the first plate 19 supporting the second recording element substrate 18 that has the rows of ejection ports 31*a*, 31*b* and 31*c*. The number of beams 33 of the center supply flow path 25*b* is greater than the number of beams 33 of each of the supply flow paths 25*a* and 25*c* that are disposed at the opposite ends.

As the number of beams 33 is increased, the volume of a supply flow path is reduced to by turn lower the capacity of the supply flow path for supplying ink from the supply flow path to the related recording element substrate. In this embodiment, the center supply flow path 25*b* is dedicated to ink of yellow, magenta or cyan that represents the lowest viscosity in order to maintain the ink supplying capacity above a certain permissible level. Since the viscosity of magenta ink is lower than that of yellow ink and that of cyan ink in an experiment conducted with this embodiment, magenta ink is supplied from the center supply flow path 25*b* to the second recording element substrate 18. Then, as a result, the temperature characteristics of the liquid ejection head can be improved while suppressing the possible lowering of ink supplying characteristics for each of the colors.

Third Embodiment

Now, the liquid ejection head of the third embodiment of the present invention will be described below by referring to FIG. 8. Recording apparatus to which this embodiment is applicable are same as the one illustrated in FIG. 1 and hence will not be described here any further. Additionally, the components of the liquid ejection head of this embodiment that are same as those of the liquid ejection head of the first embodiment and those of the liquid ejection head of the second embodiment are denoted by the same reference symbols and will not be described in detail any further.

Figure 8:
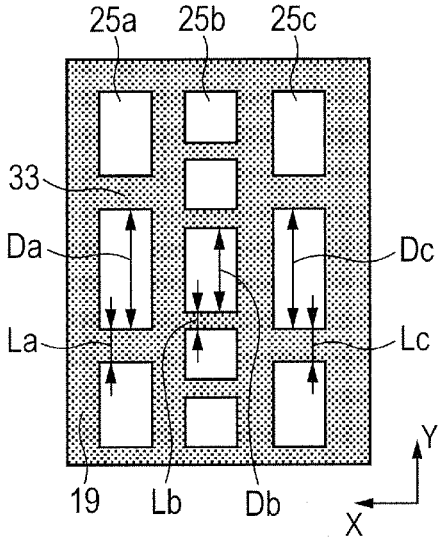
FIG. 8 is an enlarged schematic plan view of a part of the first plate of the liquid ejection head of the third embodiment of the present invention.

FIG. 8 is an enlarged schematic plan view of the part of the first plate 19 of this embodiment that supports the second recording element substrate 18 (see FIG. 2). As illustrated in FIG. 8, three supply flow paths 25*a*, 25*b* and 25*c* are formed in that part of the first plate 19. The three supply flow paths 25*a*, 25*b* and 25*c* communicate with the respective supply ports 26 (see FIG. 4B) of the second recording element substrate 18 so that ink of a plurality of colors can be supplied to the second recording element substrate 18.

Two beams 33 are arranged in each of the supply flow paths 25*a* and 25*c*. The two beams 33 of the supply flow path 25*a* and those of the supply flow path 25*c* are held in contact with the second recording element substrate 18 respectively by way of the openings of the supply flow paths 25*a* and 25*c*. On the other hand, four beams 33 are arranged in the supply flow path 25*b* and held in contact with the second recording element substrate 18 by way of the opening of the supply flow path 25*b*. As a result of providing four beams 33 in the supply flow path 25*b*, a less dispersed temperature distribution can be achieved for the portion of the second recording element substrate 18 that corresponds to the supply flow path 25*b*.

Both the gap Da separating the two beams arranged in the supply flow path 25*a* and the gap Dc separating the two beams arranged in the supply flow path 25*c* are larger than the largest gap Db of the gaps separating the four beams 33 arranged in the supply flow path 25*b*. With this arrangement, thermal energy is less easily transmitted from the part of the second recording element substrate 18 that corresponds to the supply flow path 25*a* and 25*c* and located at and near the center in the second direction Y to the beams 33 in the supply flow paths 25*a* and 25*c*. Then, as a result, temperature variance in the portions of the second recording element substrate 18 that respectively correspond to the supply flow paths 25*a* and 25*c* and also in the portion of the second recording element substrate 18 that corresponds to the supply flow path 25*b* can be suppressed.

Additionally, the width Lb of the beams 33 (namely the dimension of the beams 33 in the second direction Y) arranged in the supply flow path 25*b* is smaller than the width La of the beams 33 arranged in the supply flow path 25*a* and the width Lc of the beams 33 arranged in the supply flow path 25*c*. The ratio of the volume of the four beams 33 in the supply flow path 25*b* relative to the volume of the supply flow path 25*b* is preferably so selected as to be substantially same as the ratio of the volume of the two beams 33 in the supply flow path 25*a* relative to the volume of the supply flow path 25*a* and hence the ratio of the volume of the two beams 33 in the supply flow path 25*c* relative to the volume of the supply flow path 25*c*.

By making the ratio of the volume of the beams in a supply flow path relative to the volume of the supply flow path substantially equal for all the supply flow paths, the capacity of supplying ink from the supply flow path 25*b* to the second recording element substrate 18 can be made to be substantially same as the capacity of supplying ink from each of the supply flow paths 25*a* and 25*c* to the second recording element substrate 18.

While three supply flow paths 25*a*, 25*b* and 25*c* are formed in the portion of the first plate 19 that supports the second recording element substrate 18 in the above description of this embodiment, four or more supply flow paths may alternatively be formed in that portion. Similarly, three or more beams 33 may be arranged in each of the supply flow paths 25*a* and 25*c*. The number of beams 33 in the supply flow path 25*b* is not limited to four but allowed to be greater than the number of beams 33 in each of the supply flow paths 25*a* and 25*c*.

Fourth Embodiment

Now, the liquid ejection head of the fourth embodiment of the present invention will be described below by referring to FIGS. 9A and 9B. Recording apparatus to which this embodiment is applicable are same as the one illustrated in FIG. 1 and hence will not be described here any further. Additionally, the components of the liquid ejection head of this embodiment that are same as those of the liquid ejection head of the first embodiment, those of the liquid ejection head of the second embodiment and those of the liquid ejection head of the third embodiment are denoted by the same reference symbols and will not be described in detail any further.

Figure 9A:
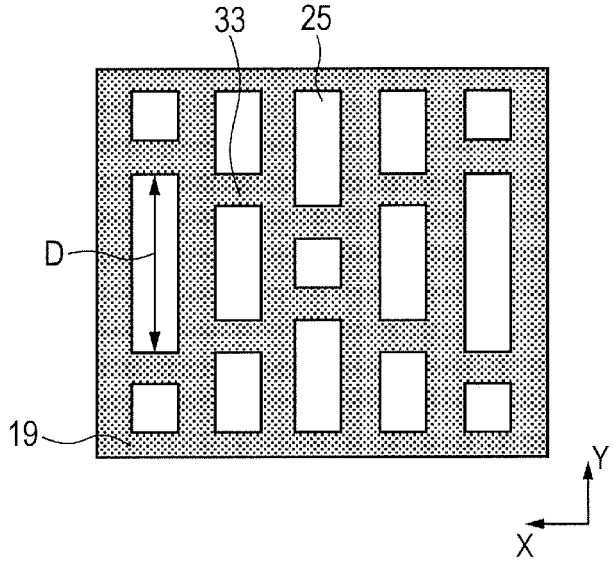
FIGS. 9A and 9B are enlarged schematic plan views of a part of the first plate of the liquid ejection head of the fourth embodiment of the present invention.
Figure 9B:
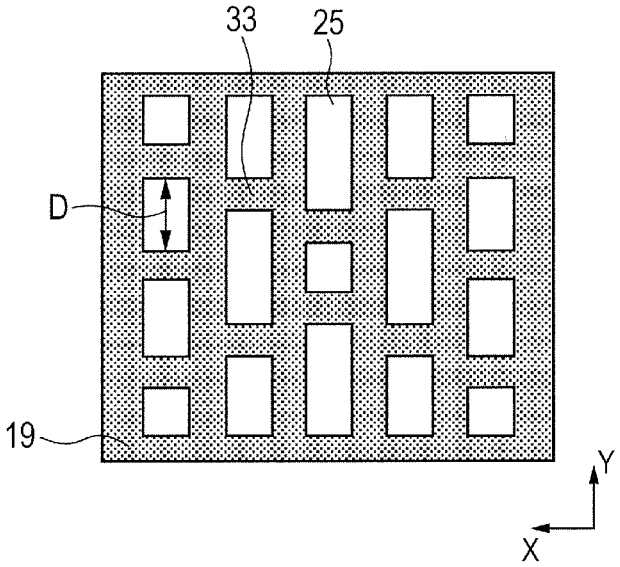

FIGS. 9A and 9B are schematic plan views of the portion of the first plate 19 of the liquid ejection head of this embodiment that supports the second recording element substrate 18 (see FIG. 2).

As illustrated in FIG. 9A, a total of five supply flow paths 25 are formed in the portion of the first plate 19 so that ink of a plurality of colors can be separately supplied to the second recording element substrate 18 (see FIG. 4B).

Two beams 33 are arranged in each of the five supply flow paths 25 and held in contact with the second recording element substrate 18 by way of the opening of the supply flow path 25. As for the gap D separating the two beams 33 arranged in each of the five supply flow paths 25, the gap D separating the two beams 33 in an outwardly disposed supply flow path 25 is greater than the gap D separating the two beams 33 in an inwardly disposed supply flow path 25 as viewed in the first direction X.

With this arrangement, thermal energy of the portion which is located at and near the center of the second recording element substrate 18 as viewed in the second direction Y is less easily transmitted from any outwardly disposed portion of the second recording element substrate 18 to the beams 33 than any inwardly disposed portion of the second recording element substrate 18 as viewed in the first direction X. Thus, as a result, temperature variance can be suppressed in the second recording element substrate 18.

Alternatively, three or more beams 33 may be arranged in some or all of the five supply flow paths 25 as illustrated in FIG. 9B. Then, the smallest gap D separating two beams 33 is employed in the supply flow paths 25 that are located outermost, whereas the largest gap D separating two beams 33 is employed in the supply flow path 25 that is located innermost. A gap D separating two beams 33 that is greater than the smallest gap D employed in the outermost supply flow paths 25 and smaller than the largest gap D employed in the innermost supply flow path 25 is applied to the remaining supply flow paths 25.

A plurality of recording element substrates is arranged on a single supporting member (supporting plate 19) in each of the above described embodiments. However, the present invention is by no means limited to such an arrangement and equally applicable to a liquid ejection head in which a single recording element substrate is provided on a single supporting member.

While the supply ports 26 formed on each of the recording element substrates are long through-holes running through the substrate and having a rectangular cross section in each of the above described embodiments, the present invention is by no means limited to such an arrangement. For example, each supply port may be provided with one or more beams to produce a plurality of openings. While the first plate 19 is made of aluminum oxide ($Al_2O_3$) in each of the above described embodiments, the first plate 19 may alternatively be made of silicon, resin or glass.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-041422, filed Feb. 28, 2012, which is hereby incorporated by reference herein in its entirety.

What is claimed is:

1. A liquid ejection head comprising:

a recording element substrate having supply ports for supplying liquid internally and adapted to apply heat to the liquid supplied from the supply ports and eject the liquid;

a supporting member having a supporting surface for supporting the recording element substrate and supply flow paths communicating with the supply ports and running through the supporting member from the supporting surface to a surface opposite to the supporting surface, the recording element substrate being so disposed as to stride over openings of the supply flow paths; and at least two beams arranged in each of the supply flow paths and held in contact with the recording element substrate, the supporting member having at least three supply flow paths, the openings of the at least three supply flow paths being aligned in a first direction running along the supporting surface, the at least two beams arranged in each of the at least three supply flow paths being separated from each other by a gap as viewed in a second direction intersecting the first direction and running along the supporting surface, the gap separating in the second direction the at least two beams arranged in each of end supply flow paths disposed at the ends as viewed in the first direction among the at least three supply flow paths being greater than the gap separating in the second direction the at least two beams arranged in a central supply flow path disposed between the end supply flow paths as viewed in the first direction.

2. The liquid ejection head according to claim 1, wherein the number of beams arranged in the end supply flow paths is greater than the number of beams arranged in the central supply flow path.

3. The liquid ejection head according to claim 1, wherein the number of beams arranged in each of the supply flow paths differs and liquid having a lower viscosity is employed for a supply flow path having a larger number of beams as compared with liquid having a higher viscosity that is employed for a supply flow path having a smaller number of beams.

4. The liquid ejection head according to claim 1, wherein the width of a beam as viewed in the second direction is smaller in one of the supply flow paths than the width of a beam in another of the supply flow paths when a larger number of beams are arranged in the one supply flow path than the number of beams in the other supply flow path.

5. The liquid ejection head according to claim 1, wherein the supporting member has at least five supply flow paths and the gap separating the at least two beams arranged in each of the at least five supply flow paths is greater in a supply flow path located more outwardly as viewed in the first direction.

6. A recording apparatus comprising:

a liquid ejection head according to claim 1; and a carriage for carrying the liquid ejection head thereon.

7. A liquid ejection head comprising:

a recording element substrate having elements for generating thermal energy to be utilized to eject liquid and supply ports for supplying liquid to the elements; and a supporting member having a supporting surface for supporting the recording element substrate and supply flow paths communicating with the supply ports and running through the supporting member from the supporting surface to a surface opposite to the supporting surface, the supply flow paths including first, second and third supply flow paths arranged in parallel in the listed order as viewed in a first direction, two beams being formed in each of the first, second and third supply flow paths so as to extend in the first direction and to be separated from each other by a gap as viewed in a second direction orthogonal to the first direction, the two beams formed in each of the first, second and third supply flow paths being held in contact with the recording element substrate, and the gap separating the two beams of each of the first and third supply flow paths, the beams being formed at a center as viewed in the second direction, being greater than the gap separating the two beams of the second supply flow path, the beams being formed at the center as viewed in the second direction.

8. The liquid ejection head according to claim 7, wherein the length of an opening formed in each of the first and third supply flow paths and located at the center as viewed in the second direction is greater than the length of an opening formed in the second supply flow path and located at the center as viewed in the second direction.

9. The liquid ejection head according to claim 7, wherein the number of beams formed in the second supply flow path is greater than the number of beams formed in each of the first and third supply flow paths.

10. The liquid ejection head according to claim 7, wherein the first, second and third supply flow paths supply ink of different colors.

* * * * *